United States Patent [19]

Nishino et al.

[11] 4,077,350

[45] Mar. 7, 1978

[54] BARGE-CARRYING SHIP

[75] Inventors: Yasushi Nishino, Akashi; Saburo Adachi, Nishinomiya; Koji Karashima, Kobe, all of Japan

[73] Assignee: Mitsubishi Jukogyo Kabushiki Kaisha, Tokyo, Japan

[21] Appl. No.: 651,062

[22] Filed: Jan. 21, 1976

[30] Foreign Application Priority Data

Jan. 28, 1975 Japan ..... 50-11540

[51] Int. Cl.[2] ..... B63B 35/40

[52] U.S. Cl. ..... 114/260; 114/72; 214/15 R

[58] Field of Search ..... 114/43.5 VC, 43.5 R, 114/72; 214/15 R, 12–14, 390; 212/3

[56] References Cited

U.S. PATENT DOCUMENTS

| | | | |
|---|---|---|---|
| 2,363,797 | 11/1944 | Lovfald | 214/15 R |
| 3,437,066 | 4/1969 | Schwendtner | 114/43.5 VC |
| 3,515,085 | 6/1970 | Auzins | 114/43.5 VC |
| 3,552,344 | 1/1971 | Wilson | 114/43.5 VC |
| 3,687,309 | 8/1972 | Macrander | 214/15R |
| 3,756,446 | 9/1973 | Macrander | 214/15 R |

*Primary Examiner*—Trygve M. Blix
*Assistant Examiner*—Stuart M. Goldstein

[57] ABSTRACT

A barge-carrying shiphaving an opening at one end provided with an elevator for lifting barges from the water surface. Rails are laid in the fore-and-aft direction on the upper deck and along the inner walls of both sides of the ship's hull for the transportation of the lifted barges to the points where they are stowed. Barge trucks equipped with low-lift means for raising and lowering the loads thereon are movable along the rails, a pair of said rails. Supports are provided protruding inwardly from the inner walls to support the barges after being moved to stowed accomodation by the trucks.

9 Claims, 8 Drawing Figures

BARGE-CARRYING SHIP

BACKGROUND OF THE INVENTION

This invention relates to a ship for transporting a number of barges or lighters carried above and below its main deck, and more specifically to such a barge-carrying ship capable of transferring the barges from and to the water surfaces at one end of the ship.

Conventional barge-carrying ships of the aforementioned character include the one illustrated in FIG. 1. The ship has on its upper deck a traveling crane *a* for handling barges. The barges *c* are hoisted at the stern and are stowed and stacked in holds via hatch openings *b* of the upper deck. In addition, they are also carried on the hatch covers.

The ship thus requires many hatch openings and transverse bulkheads or barge guides. Accordingly, the barges placed above and below the deck leave so much unused space in front and in the rear that the number of such craft to be carried is limited.

An additional problem arises from the fact that the traveling crane *a*, which is the only means for transferring the barges, requires much time to move the barges up and down and back and forth, with a consequent slowing of the cargo handling operation.

A barge-carrying ship of another conventional design is shown in FIG. 2. This type lifts barges *e* by means of an elevator *d* at the stern, moves a truck *f* from the deck into the space under each barge in the lifted position, and then lowers and carries the barge on the truck for subsequent shipboard stowage. Among the problems of this ship are the inability to utilizing the hold spaces below the lower deck for barge accommodation, impossibility of shifting barge from the space above the upper deck to that above the lower deck and vice versa, and the difficulty in sorting the barges by the ports of destination, particularly when the ship is to call on many ports, because of the limited number of decks available.

The object of the present invention is the provision of a barge-carrying ship which overcomes the aforementioned problems. Thus, the invention aims to provide a ship capable of carrying an increased number of barges with an improved loading and unloading efficiency and ease of trimming, the vessel itself being simplified in construction.

SUMMARY OF THE INVENTION

The present invention proposes a barge-carrying ship which comprises barge lifting means located at the end of the vessel for lifting barges from the water surface onto the upper deck, truck means disposed on the deck and inboard, rails on which the truck means travel fore and aft, and amidship barge lifting means including an elevator cage for lifting and lowering each barge as carried by the truck means through a hatch opening of the deck.

In accordance with another feature of the present invention, the barge lifting means includes a platform adapted to take each barge onto the middle deck or the upper deck of the ship, and roller paths for the transfer of barges provided on the platform and the ends of the decks.

According to another feature of the invention, the ship comprises means located at the end of the vessel for lifting barges from the water surface, a plurality of openings provided at the end through which the barges lifted by the lifting means are carried aboard the ship, rails laid in the fore-and-aft direction on the upper deck and along the inner walls of the both sides of the hull for the transportation of the lifted barges to the points where they are stowed, and truck means equipped with low-lift means for raising and lowering the loads thereon. The truck means are distributed at the rate of at least one per pair of rails, i.e., on the upper deck or along the inner walls of the both sides of the vessel. There is no deck in the hold except for the middle deck portion on the engine rooms, and the barges are stowed while being held by supports protruding inwardly from the inner walls of the both sides of the ship.

The above and other objects, features, and advantages of the invention will become more apparent from the following description taken in conjunction with the accompanying drawings.

DESCRIPTION OF THE INVENTION

Figure 1:
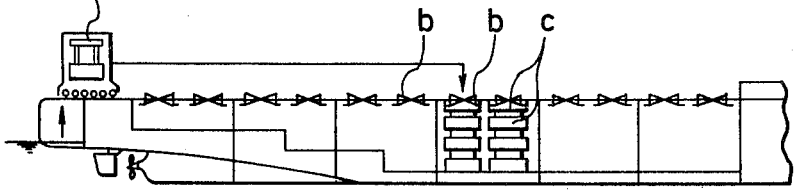
FIGS. 1 and 2 are inboard profiles of the essential parts of two different barge-carrying ships of conventional designs.
Figure 2:
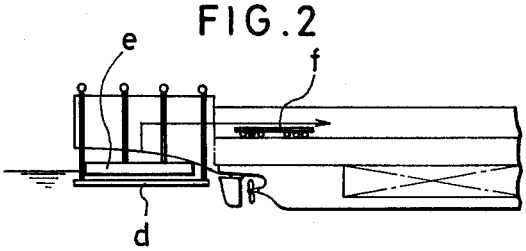
Figure 3:
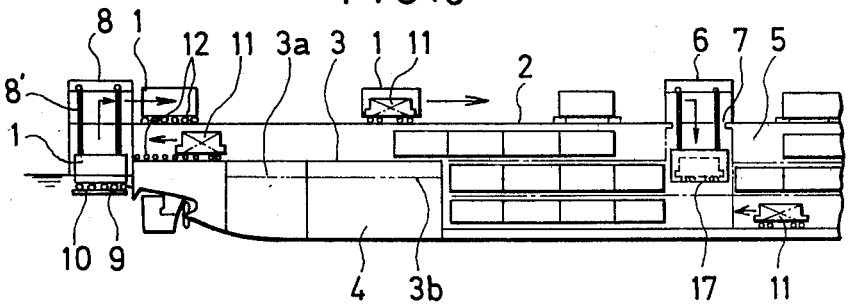
FIG. 3 is an inboard profile of the essential part of a barge-carrying ship embodying the invention.
Figure 4:
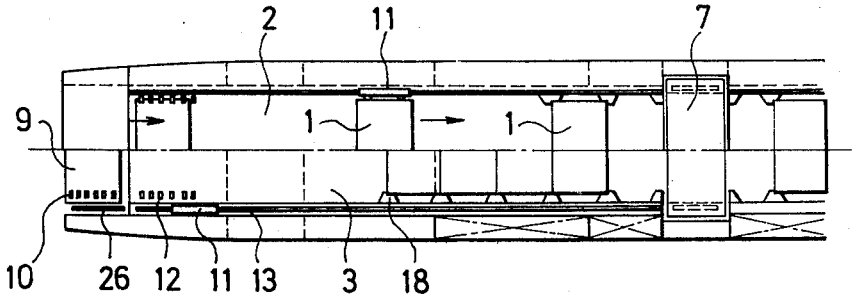
FIG. 4 is a plan view of the ship shown in FIG. 3, the upper half being that of the top surface of the vessel and the lower half that of the middle deck.

Referring now to FIGS. 3 and 4, there is shown a barge-carrying ship embodying the present invention as having an upper deck 2, a middle deck 3, and, where necessary, partial decks 3*a*, 3*b* below the middle deck. The space ahead of engine rooms 4 constitutes a hold 5 cleared of intermediate decks and transverse bulkheads. The upper deck 2 has only one hatch opening 7 amidships where a barge elevator 6 is installed. Another barge elevator 8 is provided at the stern, comprising hoist ropes 8', a platform 9, and a roller path 10 on the platform.

Each barge 1 afloat is brought onto the submerged roller path 10 on the platform 9 of the stern barge elevator 8 and is lifted to the level of the upper deck 2 or middle deck 3. The barge is then transferred from the platform 9 to either stern roller path 12 by barge-end-holding trucks 11, shipboard winch or other suitable means.

Each of the barge-end-holding trucks 11 comprises running wheels 20, stabilizing wheels 21, 22, and a hydraulic jack 14. The wheels are guided, respectively, by a truck rail 13, upper rail 23, and side rail 24. Such rails 13, 23, 24 are laid along both inner sides of the ship and extend aft to the roller paths 12. Thus, the barge-end-holding trucks 11 are provided in pairs and adapted to travel fore and aft along the both inner sides of the vessel.

The barge 1 taken over by either roller path is thence lifted slightly therefrom by a pair of barge-end-holding trucks 11, with both lower edges of the craft supported by supporting brackets in the form of prongs 15 of the hydraulic jacks 14, and is moved to a desired point within the hold or to the amidship barge elevator 6. As shown better in FIG. 7, the elevator 6, includes a cage 17, supported by hoist ropes 6' to be freely lifted and lowered along longitudinal bulkheads 16 of the ship.

Upon arrival at the desired point for stowage, the barge 1 is lowered, by means of the hydraulic jacks, to rests 18 protruding horizontally and inwardly from the longitudinal bulkheads 16 or to rests 19 similarly protruding from the cage 17, as the case may be.

The barge 1 may be loaded and stowed in the hold 5 ahead of the engine room 4 and below the middle deck 3 by moving the trucks 11 into the amidship barge elevator 6, lowering the barge 1 either supported by the trucks or placed on the rests 19 of the cage 17 to a desired floor, and then moving the barge on the trucks forwardly or backwardly to the point where the craft is to be stowed. Instead, the barge may be shifted from the hold 5 onto the deck above by reversing the afore-said procedure with the same elevator 6.

Figure 5:
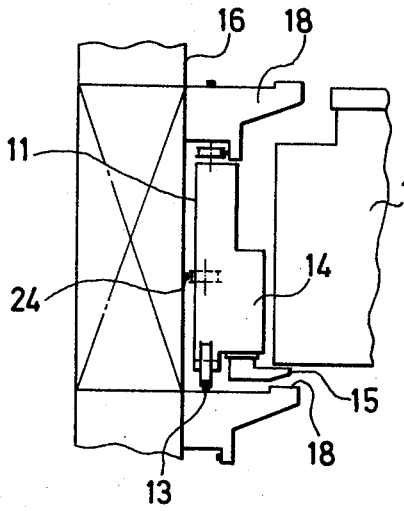
FIGS. 5 and 6 are fragmentary views illustrating the operative relationship between a barge-end-holding truck and a barge.
Figure 6:
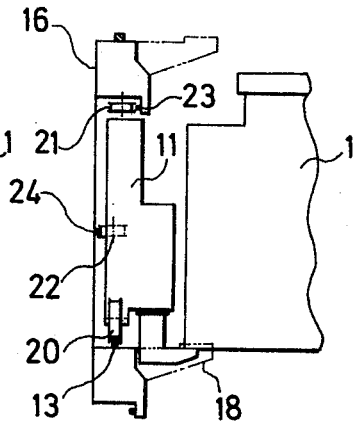

FIG. 5 shows the barge-end-holding truck 11 traveling with a barge 1, and FIG. 6 shows the barge supported stationarily on a rest 18. The truck 11 may be either a free, trailing carrier or a power-driven one. In the latter case the truck has a built-in drive within the truck frame and receives energy supplied from the outside. Operation of the paired trucks along the inner walls of the both sides of the ship is synchronized electrically, mechanically or by other suitable means. The same applies to the manipulation of the hoist ropes on the both sides of the stern and amidship barge elevators 8, 6.

Figure 7:
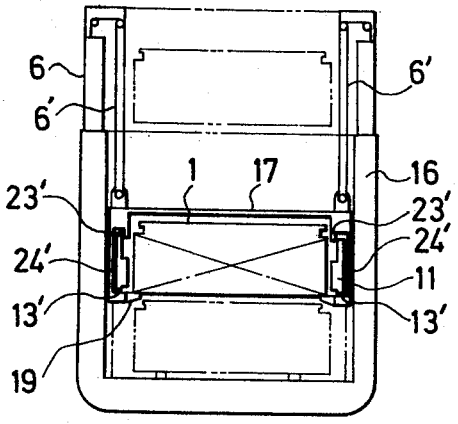
FIG. 7 is a transverse section through the hull illustrating an amidship barge elevator.

FIG. 7 shows the amidship barge elevator 6, with the cage 17 having truck rails 13', upper rails 23', and side rails 24' laid on both sides facing the inner sides of the ship in a manner corresponding to those rails shown in FIGS. 5 and 6. The both side portions of the cage 17 are connected at the top ends by horizontal upper frames. At the lower ends of the both side portions are provided movable rests 19 which can support the barge stationarily. The side portions of the cage are movable upward and downward along guides (not shown) provided on the longitudinal bulkheads 16 of the ship.

Figure 8:
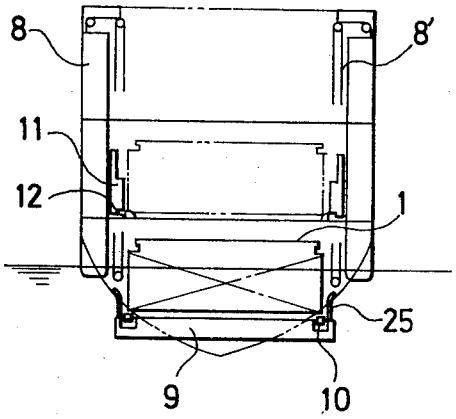
FIG. 8 is a transverse section through the hull illustrating a stern barge elevator.

FIG. 8 shows the stern barge elevator 8. The roller path 10 consists of a desired number of rollers arranged in parallel rows on the both side portions of the platform 9. Each roller is equipped with a shock absorber and is rotatably supported by the platform. Along and outwardly of the rows of the rollers there are provided barge guides 25. The platform 9 can be lifted and lowered along guides (not shown) provided on the inner surface of the hull structure on both sides of the ship or on the inner surface of the stern doors 26.

When a barge 1 comes close astern to the ship so as to be lifted aboard the ship, the platform 9 is lowered into the sea, the barge is towed thereon, and then the platform is lifted together with the barge 1 by pulling the hoist ropes 8' upward to the level of the middle deck as shown in FIG. 8. Following this, the barge is transferred onto the roller path 12 and supported by the pair of trucks 11.

With the construction thus far described, the barge-carrying ship in accordance with the present invention offers the following advantages:

(1) The barge lifting means permits transfer of barges from deck to deck, or level to level, facilitates trimming or sorting of barges by the ports of call, and makes the cargo shifting and stowing easy.

(2) Since the barge-end-carrying trucks can be transferred from level to level by the lifting means, there is no necessity of apportioning barge trucks among the levels as in the prior art arrangements. This makes it possible to reduce the number of trucks, replace any truck in trouble by one from another level, and move the trucks easily to a repair shop in or out of the ship for inspection and repairs.

(3) While an overhead-traveling crane and ordinary trucks require extra spaces throughout their paths, the barge-end-holding trucks of an upright construction according to the invention save much of the wasteful spaces. The merit of little space requirements, especially above and below the trucks and the barges carried thereby, results in other advantages of improved stability of the ship with the low center of gravity of the total cargo load, and saving of the ship cost due to a decreased depth of the hull.

(4) With a traveling crane as aboard an ordinary barge-carrying ship, the barge lifting time at the end of the vessel has to be sacrificed greatly by the travel of the crane and the use of the crane for handling the barge inside the vessel. According to the present invention, by contrast, the barge lifting means amidships combines with the barge-end-holding trucks to allow the stern barge elevator to work at full capacity, thus achieving a material improvement in the overall barge handling efficiency.

(5) As the barges afloat may be directly taken onto the middle deck, too, the speed of barge handling in the fore-and-aft direction is practically doubled and the cargo trimming is facilitated.

(6) There is no necessity of providing lifting hooks or suchlike fixtures on each barges.

(7) Barges lifted by the lifting means at the ship's end are then led into the vessel by way of a roller path. The arrangement enables the barges to be taken into the ship even when there is some gap between the elevator platform and the ship's end, for example, when the doors at the end of the middle deck are open.

It is noted, however, that rails must be inserted into the gap when the trucks are to be moved onto the platform and, in that case, exact leveling is required.

(8) Handling of barges into and out of the ship is simplified and stevedoring is made easy.

In particular, the ship embodying the invention as illustrated in FIGS. 3 through 8 has the following inherent advantages:

(a) Decks and transverse bulkheads are omitted from the hold space. For the hull strength, hatch openings in the main deck can be eliminated with the exception of one for the amidship barge elevator.

(b) Cleared of the structures that would otherwise provide interruptions, the hold can accommodate a greatly increased number of barges with little unused spaces ahead and behind and above and beneath.

(c) With the decrease of the hatch opening structures, the number of barges carried on the deck is increased.

(d) Long and huge cargoes can be stowed on the middle deck level.

(e) The barge guides 25 of the stern barge elevator constrain the movement of each barge adrift at the mercy of waves to some extent, so that with the rise of the platform 9 the barge is set in position on the roller assemblies 10.

(f) Loading of barges in a high sea is done without difficulty.

What is claimed is:

1. A barge carrying ship comprising a vessel having a deck for receiving barges, an open hold space for storing said barges and a hatch in said deck communicating with said hold, a first elevator at one end of said vessel for lifting and lowering a barge to and from said deck, rail means extending from said first elevator to said hatch, truck means adapted to travel on said rail means, each said truck means comprising a pair of independent and separate trucks located on said rail means relative to each side of the vessel, said trucks each having a separate support bracket extending laterally therefrom in a horizontally fixed position to engage and support said barge, and means for moving said barge and associated truck means to and from said first elevator and said hatch and a second elevator located in said hatch to lower and lift said barge and said associated truck means to and from said hold.

2. The barge carrying ship according to claim 1, wherein said hold has longitudinally extending inner walls and includes second rail means located on said walls for receiving said truck means to permit said truck means to move the associated barge to a selected stowe position within said hold.

3. The barge carrying ship according to claim 2, including support means protruding from the inner walls of said hull to support said barge in its stowed position.

4. The barge carrying ship according to claim 3, wherein said truck means comprises a pair of members each adapted to engage one end of the barge and having jack means for lifting and lowering said barge and driven wheel means.

5. The barge carrying ship according to claim 1, including means for transferring the barge from said first elevator to said truck means comprising roller conveyor means located on said elevator and on the adjacent portion of the deck interposed between said first elevator and said rail means.

6. The barge carrying ship according to claim 1, wherein said second elevator comprises a cage for supporting said barge and associated truck means and means for lifting and lowering said cage.

7. The barge carrying ship according to claim 1, including at least one other deck extending between said first and second elevators.

8. The barge carrying ship according to claim 2, wherein said second rail means are arranged in pairs for supporting said barges and associated truck means, and including a plurality of pair of second rail means arranged within said hold spaced one above the other to provide a plurality of levels for storing said barges and truck means.

9. The barge carrying ship according to claim 4, wherein said truck means is generally planar and has wheel means movably supporting said truck means with said plane vertically disposed, and said rail means having a lower rail portion for supporting said truck means and an upper rail portion to maintain said truck means in vertical disposition, said jack means having a support bracket extending laterally from said truck means to engage below the barge.

* * * * *